US006183151B1

(12) United States Patent
Kono

(10) Patent No.: US 6,183,151 B1
(45) Date of Patent: Feb. 6, 2001

(54) SHEET FEEDING APPARATUS

(75) Inventor: Takeshi Kono, Yokohama (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/343,084

(22) Filed: Jun. 30, 1999

(30) Foreign Application Priority Data

Jul. 6, 1998 (JP) ..... 10-190073

(51) Int. Cl.[7] ..... B41J 13/00
(52) U.S. Cl. ..... 400/582; 400/578
(58) Field of Search ..... 400/582, 578, 400/624, 596, 605

(56) References Cited

U.S. PATENT DOCUMENTS 4,925,325 * 5/1990 Nikawa ..... 400/582
5,358,235 * 10/1994 Konno et al. ..... 271/227
5,480,247 * 1/1996 Saikawa et al. ..... 400/624
5,584,590 * 12/1996 Ito et al. ..... 400/605
5,810,492 * 9/1998 Akahane et al. ..... 400/582
5,927,703 * 7/1999 Endo ..... 271/10.03
5,967,677 * 10/1999 McCue et al. ..... 400/582

FOREIGN PATENT DOCUMENTS

401009767 * 1/1989 (JP) ..... 400/582
404062077 * 1/1989 (JP) ..... 400/582

* cited by examiner

*Primary Examiner*—John S. Hilten
*Assistant Examiner*—Anthony H. Nguyen
(74) *Attorney, Agent, or Firm*—Fitzpatrick, Cella, Harper & Scinto

(57) ABSTRACT

The present invention provides sheet feeding apparatus comprises a sheet stacking means, a sheet feeding rotary member, conveying means, leading edge detecting means, driving means, and control means, and the control means controls a conveying amount of the sheet by the normal and reverse rotations of the conveying means, in accordance with a sheet leading edge blank amount and a normal rotation convey amount of the sheet.

6 Claims, 11 Drawing Sheets

SHEET FEEDING APPARATUS

BACKGROUND OF THE INVENTION

1. Field of the Invention

The present invention relates to a sheet feeding apparatus for feeding sheets one by one, and more particularly, it relates to a sheet feeding apparatus used with a recording apparatus such as a copying machine, a printer and the like.

2. Related Background Art

In the past, there has been proposed a sheet feeding apparatus used with a recording apparatus such as a copying machine, a printer and the like, in which, for example, sheets are fed out one by one by means of a semi-circular feed roller one rotation of which is controlled, and the fed sheet is supplied to a recording portion by a convey roller. The feed roller is provided with a flag in order to stop the feed roller after one rotation, and, by detecting the flag by a sensor (photo-interrupter or the like), completion of one rotation of the feed roller is detected. Further, in a drive system, a driving force of a convey roller rotatable normally and reversely is switched by a pendulum gear to effect connection or disconnection of transmission of the driving force. That is to say, when the convey roller is rotated in a normal direction, the driving force is transmitted to the feed roller by the pendulum gear; whereas, when the convey roller is rotated in a reverse direction, the transmission of the driving force is released. Incidentally, in the released position, a slide lever can be fitted into a support member of the pendulum gear to fixedly keep the posture of the gear, and, when the convey roller is rotated in the normal direction, only the convey roller can be rotated. The slide lever is disengaged from the support member of the pendulum gear when a carriage on which a recording head is mounted is shifted up to an end of the apparatus, with the result that the pendulum gear can freely be moved. In the condition that the fixing of the pendulum gear is released, when the convey roller is rotated in the normal direction, the feed roller is rotated together with the convey roller.

In a fundamental flow of the sheet in the sheet feeding, first of all, the carriage is shifted up to the end of the apparatus to rotate the convey roller and the feed roller, thereby feeding out a single sheet. When the completion of one rotation of the feed roller is detected by the sensor, the convey roller is rotated in the reverse direction by a predetermined amount, thereby releasing the transmission of the driving force to the feed roller. Here, when the carriage is returned toward a center of the apparatus, the slide lever is fitted into the support member of the pendulum gear to fix the posture of the gear, and only the convey roller is rotated, with the result that the sheet is conveyed to the recording portion only by the convey roller.

However, due to dispersion in sheet features, since a time period from when the rotation of the feed roller is started to when a leading edge of the sheet reaches a sheet leading edge detecting sensor (referred to as "PE sensor" hereinafter) is varied from sheet to sheet, when one rotation of the feed roller is completed, a distance from the convey roller (sheet leading edge detecting sensor) to the leading edge of the sheet is also varied from sheet to sheet. Thus, a dispersion correcting operation, i.e., a feeding operation of the leading edge to an initial position in which, as shown in FIGS. 9A to 9D, after one rotation of the feed roller is completed, the sheet is set at an image leading portion recording position by reverse and normal rotations of the convey roller is required.

In FIGS. 9A to 9D, "P" indicates the sheet; 100 denotes the convey roller; 101 denotes the PE sensor (sheet leading edge detecting sensor); and 102 denotes the recording head. Further, "$\beta$" indicates a normal convey distance of the sheet P from when the leading edge of the sheet is detected by the PE sensor 101 to when one rotation of the feed roller is completed; "$\epsilon$" indicates a distance from the PE sensor 101 to a recording position of the recording head 102; "$\gamma$" indicates a reverse rotation amount required for the above-mentioned drive switching; "$\sigma$" indicates a backlash correction amount when the normal rotation is effected again; "$\delta 1$" indicates a blank amount from the leading edge of the sheet to a leading portion of a record permitting area; and "$\delta 2$" indicates a blank amount from the leading portion of the record permitting area to an image leading end portion based upon image data.

FIG. 9A shows a condition that the sheet P is fed out by the distance $\beta$ after one rotation of the feed roller was completed. FIG. 9B shows a condition that the sheet is returned by rotating the convey roller reversely by an amount corresponding to by the sum of the reverse rotation amount $\gamma$ required for the drive switching, an excessive fed amount in FIG. 9A and the backlash correction amount $\sigma$ of the drive switching portion. In this case, the reverse rotation amount of the convey roller is defined as $(\beta-\epsilon+\sigma-\delta 1)$, and diameters of the rollers are designed so that this reverse rotation amount becomes greater than the reverse rotation amount $\gamma$ required for the drive switching without fail. FIG. 9C shows a condition that the sheet is fed out by rotating the convey roller in the normal direction by the backlash correction amount $\sigma$. As a result, the leading portion of the record permitting area is fed to the recording position (record starting position) of the recording head. FIG. 9D shows a condition that the sheet is fed out by rotating the convey roller in the normal direction by the blank amount $\delta 2$ with reference to the blank amount $\delta 2$ to the image leading portion based upon the image data. From this condition, the recording is started.

However, in the above-mentioned conventional apparatus, as mentioned above, since the leading edge of the sheet is returned up to the recording position of the recording head and then is fed out by the blank amount regardless of the image data, the shifting amount and time of the sheet required for the heading to the recording position become great, thereby worsening the record processing speed of the recording apparatus.

Concretely, for example, when $\beta=20$ mm, $\epsilon=8$ mm, $\gamma=5$ mm, $\sigma=1$ mm, $\delta 1=2$ mm and $\delta 2=4$ mm, the shifting amount of the sheet required for the heading will be $(\beta-\epsilon+\sigma-\delta 1+\sigma-\delta 2)=16$ mm.

SUMMARY OF THE INVENTION

Accordingly, an object of the present invention is to provide reduce a shifting amount of a sheet required for heading to a recording position, thereby improving a processing speed of an apparatus.

The present invention provides a sheet feeding apparatus comprising a sheet stacking means for supporting a sheet, a sheet feeding rotary member for feeding out the sheet from the sheet stacking means by one rotation control, a conveying means for conveying the sheet fed out by the sheet feeding rotary member to a recording means, a leading edge detecting means for detecting a leading edge of the sheet fed out by the sheet feeding rotary member, a driving means for rotating the conveying means in normal and reverse directions, and a control means for controlling the driving means, and wherein the control means controls a conveying amount of the sheet by the normal and reverse rotations of the conveying means, in accordance with a sheet leading edge blank amount obtained by adding a blank amount between the leading edge of the sheet and a leading portion of a record permitting area to a blank amount at a leading edge of image data, and, a normal rotation conveying amount of the sheet from when the leading edge of the sheet is detected by the leading edge detecting means to when one rotation of the sheet feeding rotary member is completed, referring to the blank amount at the leading edge of image data prior to initiation of feeding of the leading edge of the sheet to an initial position, when the sheet is conveyed to feed the leading edge of the sheet to an initial position after the sheet is fed out by one rotation of the sheet feeding rotary member.

DESCRIPTION OF THE PREFERRED EMBODIMENTS

The present invention will now be fully explained in connection with a sheet feeding apparatus and a recording apparatus according to an embodiment with reference to the accompanying drawings.

Now, a sheet feeding apparatus and a recording apparatus according to an embodiment of the present invention will be described in detail with reference to the accompanying drawings. Incidentally, in this embodiment, an ink jet recording apparatus having an automatic sheet feeding apparatus as the sheet feeding apparatus will be explained as an example.

Figure 1:
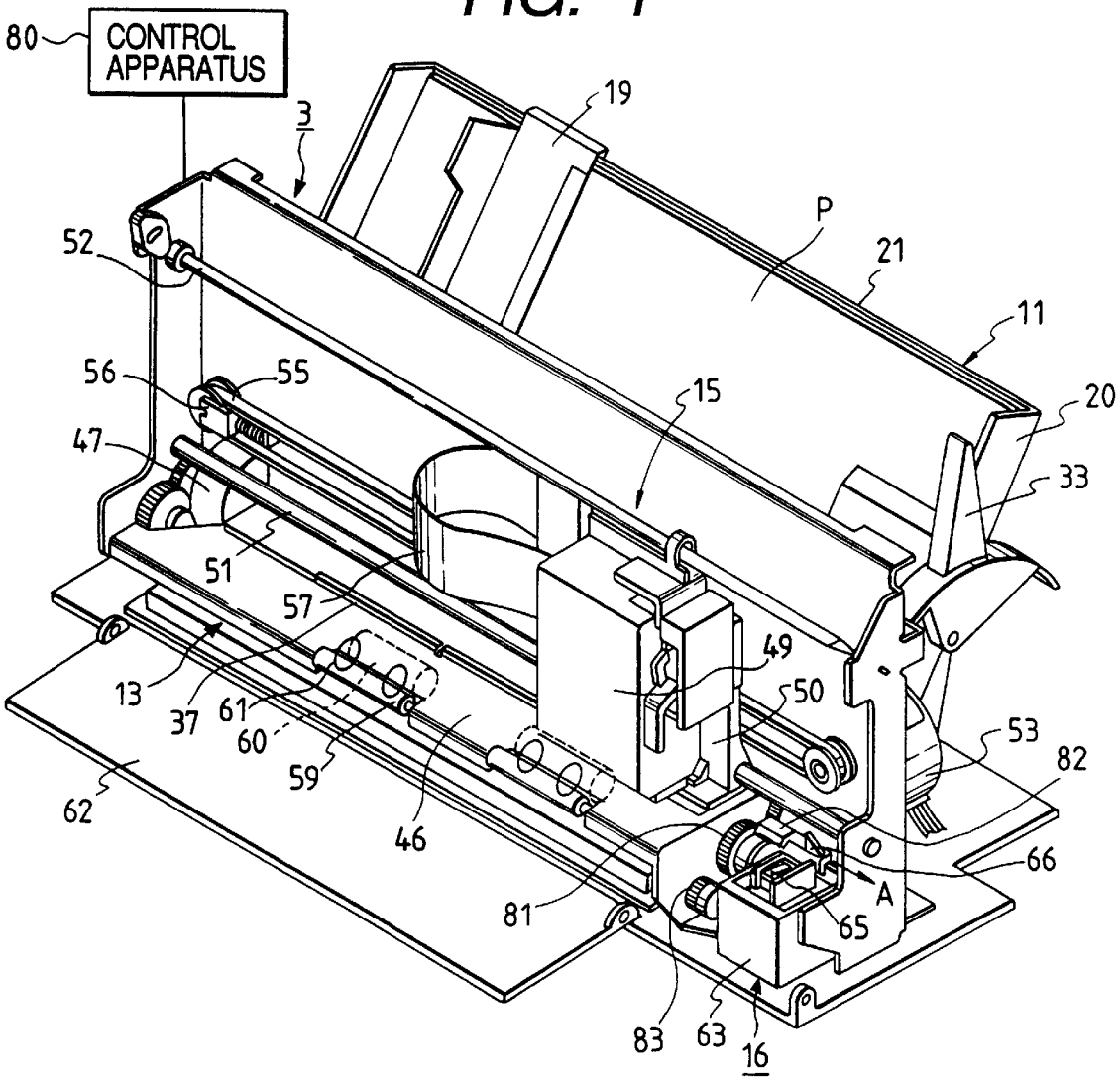
FIG. 1 is a perspective view showing a schematic construction of a recording apparatus having an automatic sheet feeding apparatus.
Figure 3:
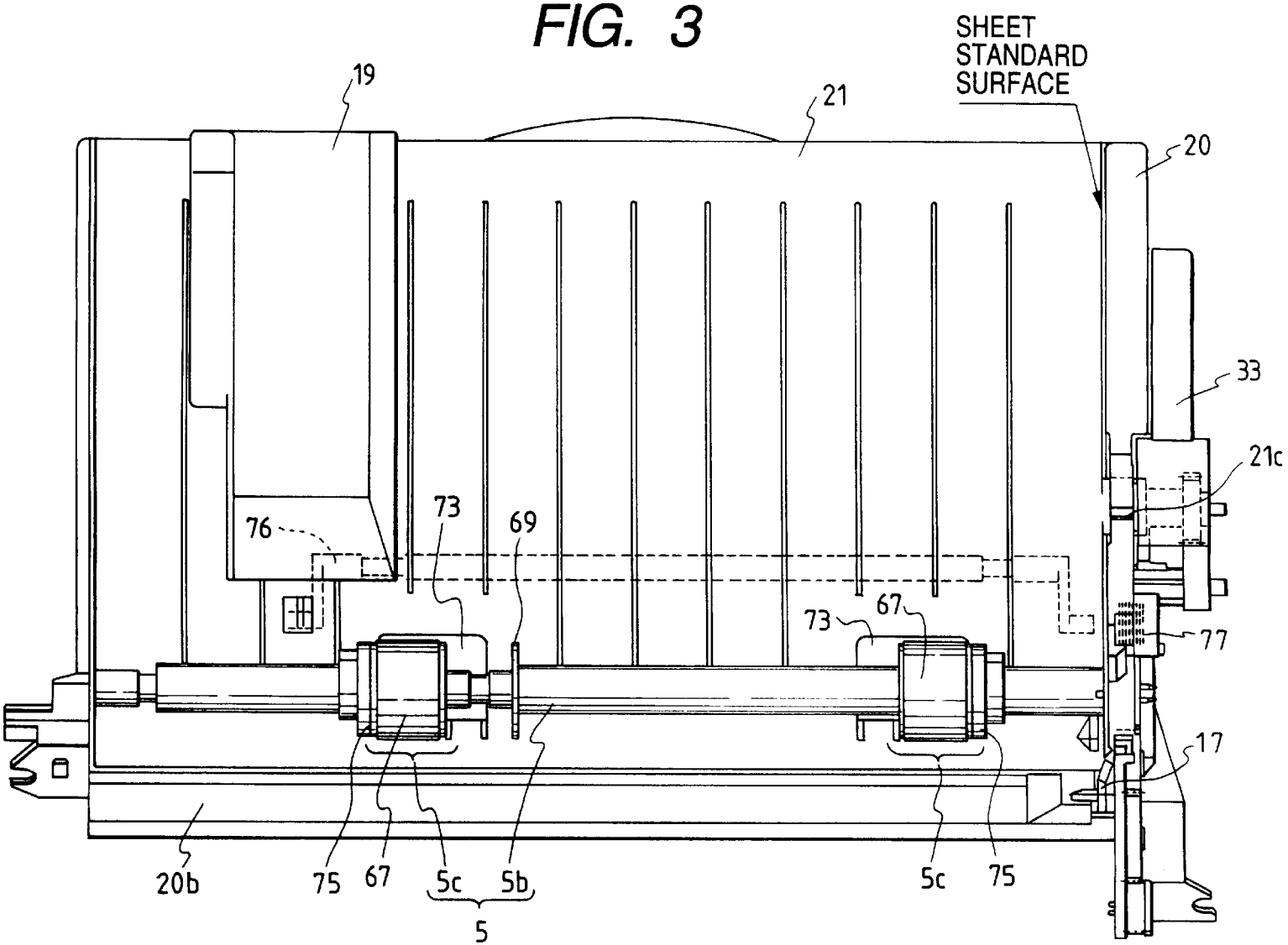
FIG. 3 is a plan view of the automatic sheet feeding apparatus.
Figure 4A:
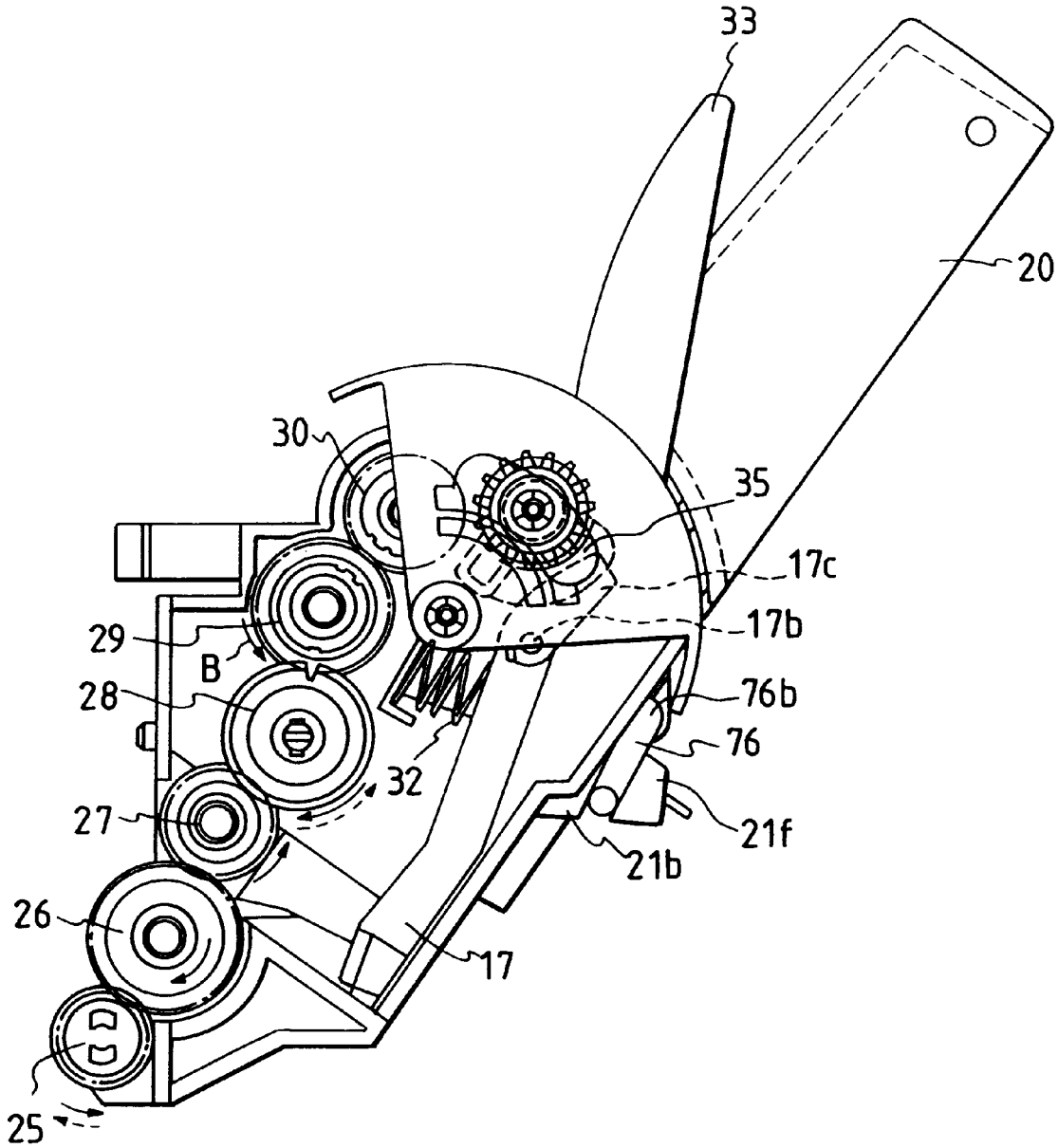
FIGS. 4A and 4B are side views of the automatic sheet feeding apparatus.
Figure 4B:
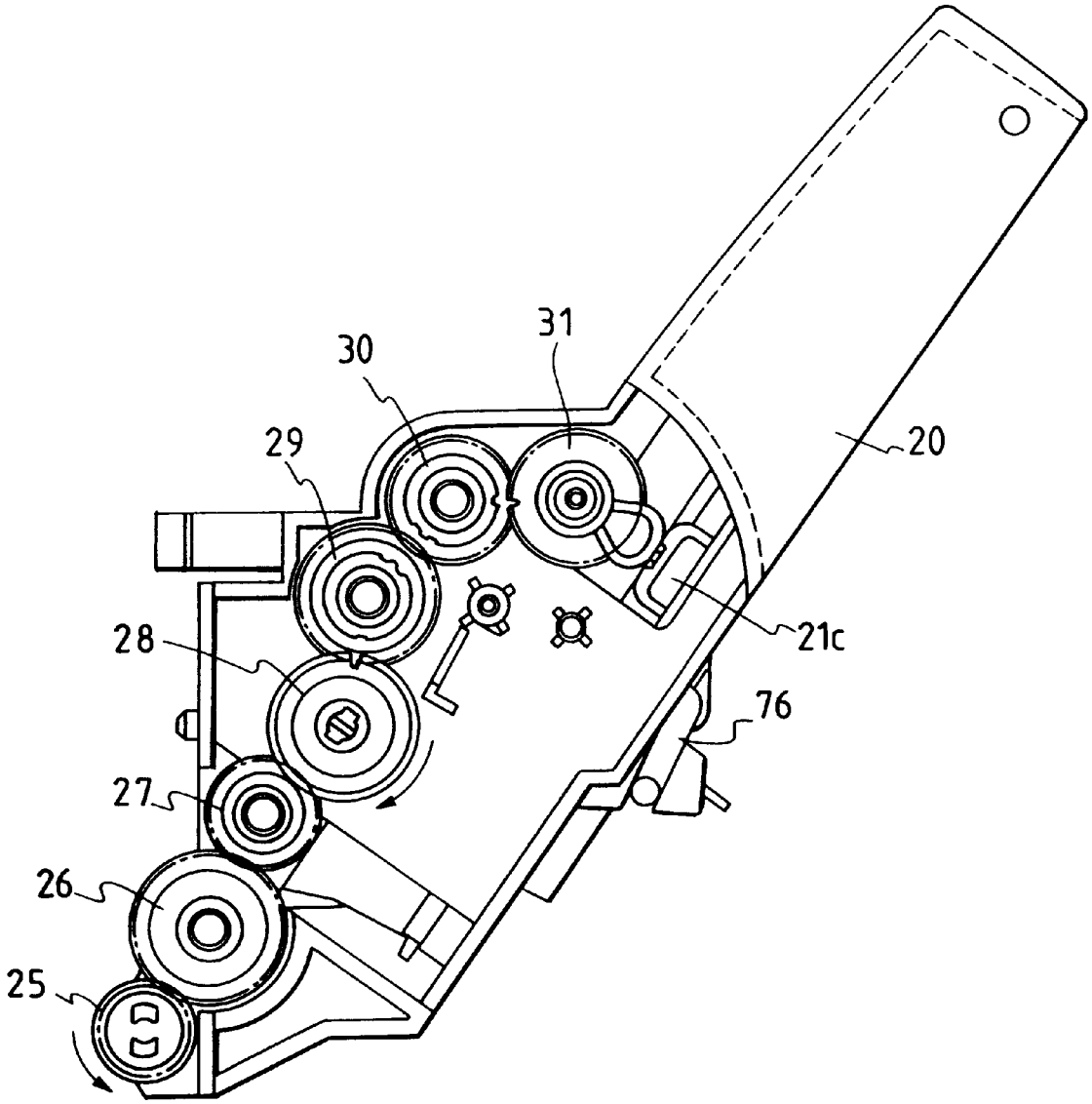

FIG. 1 is a perspective view showing a schematic construction of the recording apparatus having the automatic sheet feeding apparatus in this embodiment. In FIG. 1, a sheet feeding portion 11 as the automatic. sheet feeding apparatus is attached to a main body 3 of the apparatus at an angle of 30 to 60 degrees. Sheets P set in the sheet feeding portion 11 are to be discharged horizontally after recording. The sheet feeding portion 11 includes a sheet feeding roller 5, a separation claw 17, a movable side guide 19, a base 20, a pressure plate 21 (all are shown in FIG. 3), pressure plate springs 22 (FIGS. 5A and 5B), gears 25 to 30, a release cam 31, a claw spring 32, a releasing lever 33 and a releasing cam 35 (all are shown in FIGS. 4A and 4B). Normally, the pressure plate 21 is lowered to a position shown in FIG. 5A by the release cam 31, with the result that the sheet P is spaced apart from the sheet feeding roller 5.

In a condition that the sheets P are set, a driving force of a convey roller 36 (FIGS. 7A to 7C and FIGS. 8A to 8C) is transmitted to the sheet feeding roller 5 and the release cam 31 through the gears 25 to 30. When the release cam 31 is separated from the pressure plate 21, the pressure plate 21 is lifted up to a position shown in FIG. 5B, with the result that the sheet P contacts with the sheet feeding roller 5. The sheets P are picked up by rotation of the sheet feeding roller 5 and are separated one by one by the separation claw 17. The separated sheet P is sent to a sheet convey portion 12. The sheet feeding roller 5 and the release cam 31 are rotated by one rotation until the sheet P is sent to the sheet convey portion, and, in the condition that the pressure plate 21 is released from the sheet feeding roller 5 is restored again, the driving force from the convey roller 36 is disconnected, and this initial condition is maintained.

The sheet convey portion includes the convey roller 36, a pinch roller 37, a PE sensor 42 (all are shown in FIGS. 7A to 7C and FIGS. 8A to 8C), and a platen 46 (FIG. 1). The sheet P sent to the sheet convey portion is guided by the platen 46, a pinch roller guide (not shown) and an upper guide (not shown) and is sent to a pair of rollers comprised of the convey roller 36 and the pinch roller 37. The PE sensor 42 is disposed in front of the pair of rollers. When a leading edge of the sheet P is detected by the PE sensor 42, a printing position on the sheet P is determined by the PE sensor 42. The pinch roller 37 is biased by a pinch roller spring (not shown) via the pinch roller guide so that the pinch roller is urged against the convey roller 36, thereby providing a conveying force for the sheet P.

The sheet P sent by the pair of rollers 36, 37 is advanced on the platen 46 by the pair of rollers 36, 37 rotated by an LF motor (convey motor) 47; meanwhile, the recording is effected by a recording head 49 on the basis of predetermined image information. Incidentally, the recording head 49 is of ink jet recording type for effecting the recording by discharging ink, and in the illustrated embodiment, the recording head is integrally formed with an ink tank to form an easy replaceable ink jet recording head. The recording head has electrical/thermal converters so that ink is discharged from a discharge port by growth and contraction of a bubble generated in the ink by film-boiling caused by thermal energy created by energizing the electrical/thermal converter in response to a record signal, thereby effecting the recording.

Figure 2A:
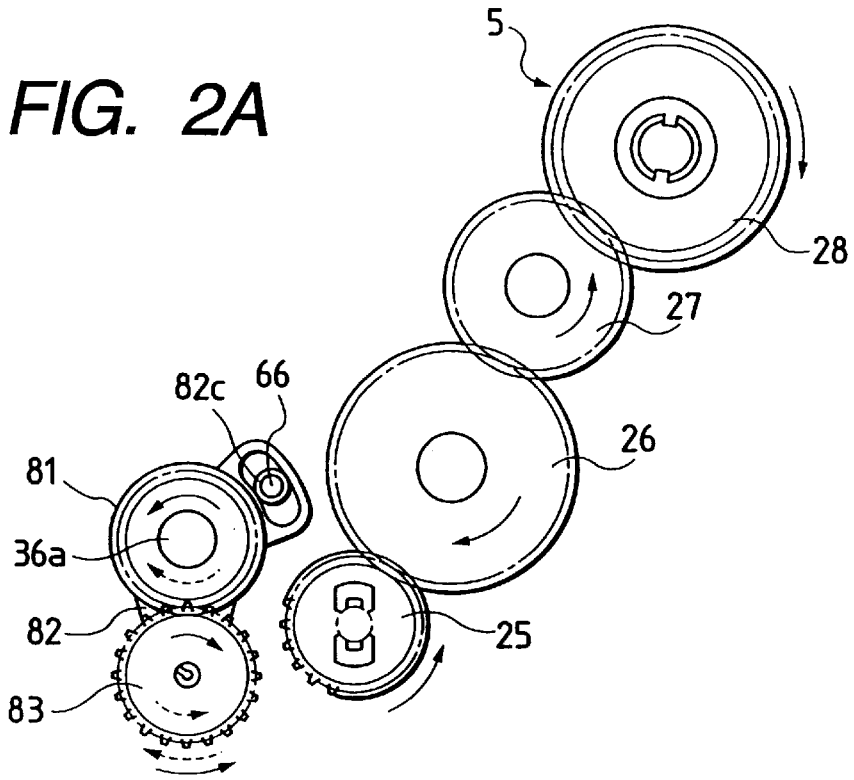
FIGS. 2A and 2B are explanatory views showing a gear switching portion between a conveying roller and a sheet feeding roller.
Figure 2B:
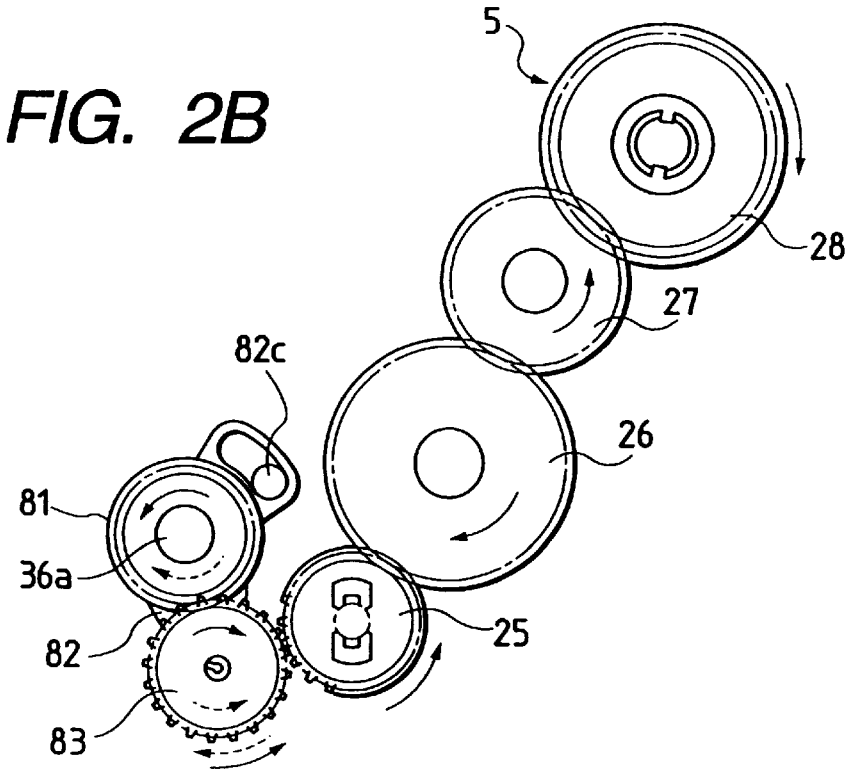

In FIGS. 2A and 2B, a switching output gear 81 is integrally formed with the convey roller 36 and is reversibly rotated by the LF motor 47. A switching arm 82 has a base portion rotatably mounted on a support shaft 36*a* integral with the convey roller 36. A switching output gear 83 is rotatably mounted on a free end of the switching arm 82 and can be engaged with the input gear 25 by rotation of the switching arm 82 to transmit normal rotation of the convey roller 36 to the input gear 25 and the associated sheet feeding roller 5. A control apparatus 80 controls rotations of the LF motor 47 and the convey roller 36 in a manner which will be described later.

A carriage portion (recording portion) 15 includes a carriage 50 to which the recording head 49 is attached, a guide shaft 51 for guiding reciprocal scan of the carriage 50 in a direction perpendicular to a conveying direction of the sheet P, a guide 52 for holding a rear end (at an upper part of the apparatus) of the carriage 50 to maintain a predetermined gap between the recording head 49 and the sheet P, a timing belt 55 for transmitting drive of a carriage motor 53 to the carriage 50, an idle pulley 56 for applying tension to the timing belt 55, and a flexible cable 57 for transmitting a head drive signal from an electric substrate to the recording head 49. The recording head 49 is scanned together with the carriage 50 in the direction perpendicular to the sheet conveying direction, so that the image is formed on the sheet P being conveyed on the platen 46.

A sheet discharge portion includes sheet discharge rollers 59, transmission rollers 60 for transmitting the driving force of the convey roller 36 to the sheet discharge rollers 59, spurs 61 for aiding sheet discharging, and a sheet discharge tray 62. The sheet P is discharged onto the sheet discharge tray 62 by the sheet discharge rollers 59 and the spurs 61 without distorting the image on the sheet P. Incidentally, the spurs are so designed as to have small contact area with the sheet, so that, even when the spurs are contacted with the imaged surface of the sheet, the image on the sheet is not distorted.

A cleaning portion 16 includes a pump 63 for cleaning the recording head 49, a cap 65 for preventing drying of the recording head 49, and a drive switching lever 66 for switching the driving force of the convey roller 36 between the sheet feeding portion 11 and the pump 63. When the sheet is fed, except for cleaning, the drive switching lever 66 is in a condition that the lever is entered into a hole 82*c* of the switching arm 82 shown in FIG. 2A, so that, since the switching output gear 83 to be rotated around a center of the convey roller 36 is fixed or secured at a predetermined position, the driving force of the convey roller 36 is not transmitted to the pump 63 and the sheet feeding portion 11.

By shifting the carriage 50, when the drive switching lever 66 is shifted in a direction shown by the arrow A in FIG. 1, the drive switching lever 66 is disengaged from the hole 82*c* of the switching arm 82, and the switching output gear 83 is shifted as shown in FIGS. 2A and 2B by the normal or reverse rotation of the convey roller 36. In a condition that the carriage 50 is secured at the shifted position in the direction A, when the convey roller 36 is rotated normally, the driving force of the LF motor 47 is transmitted to the sheet feeding portion 11; whereas, when the convey roller 36 is rotated reversely, the driving force of the LF motor 47 is transmitted to the pump 63.

Further, as the LF motor for driving the convey roller 36 and the carriage motor 53 for driving the carriage 50, stepping motors rotated by predetermined angles in response to signals sent from drivers (not shown) are used.

As shown in FIG. 3, the sheet feeding roller 5 is provided with a sensor plate 69 having a diameter smaller than a diameter of a sheet feeding rubber 67 attached to the sheet feeding roller 5. The sensor plate 69 has a cut-out portion so that, only when the sheet feeding roller 5 and the release cam 31 are located at their initial positions (FIG. 5A) where the pressure plate 21 is released, light from a roller sensor comprised of a photo-interrupter directly attached to the electric substrate (not shown) is not interrupted. By detecting the condition of the sensor plate 69, an angular position of the sheet feeding roller 5 and an angular position of the release cam 31 operated in synchronous with the sheet feeding roller 5 with the same phase can be detected, thereby providing a control timing of the sheet P in a sheet feeding sequence.

Figure 5A:
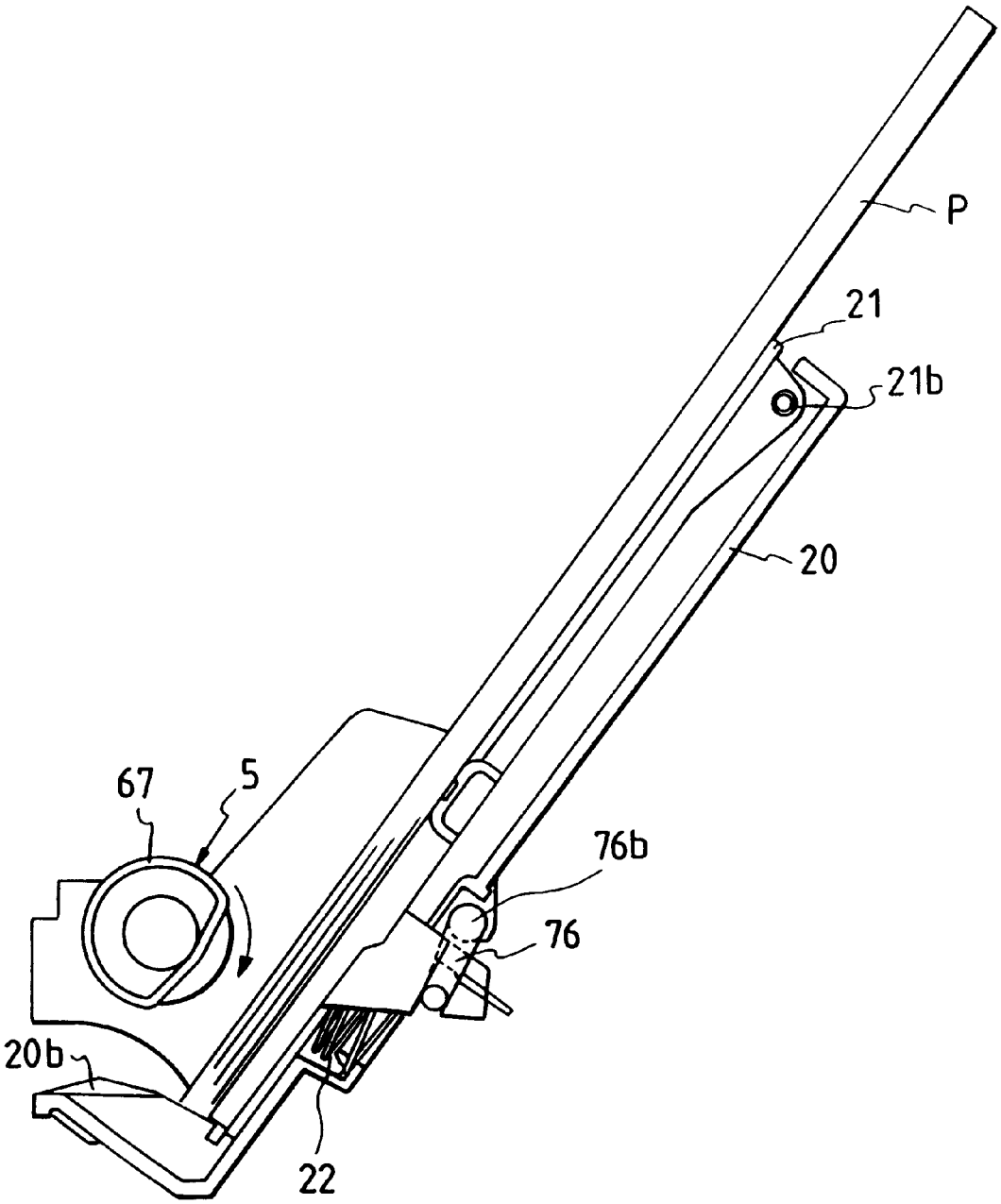
FIGS. 5A and 5B are side views of a sheet feeding roller portion of the automatic sheet feeding apparatus.
Figure 5B:
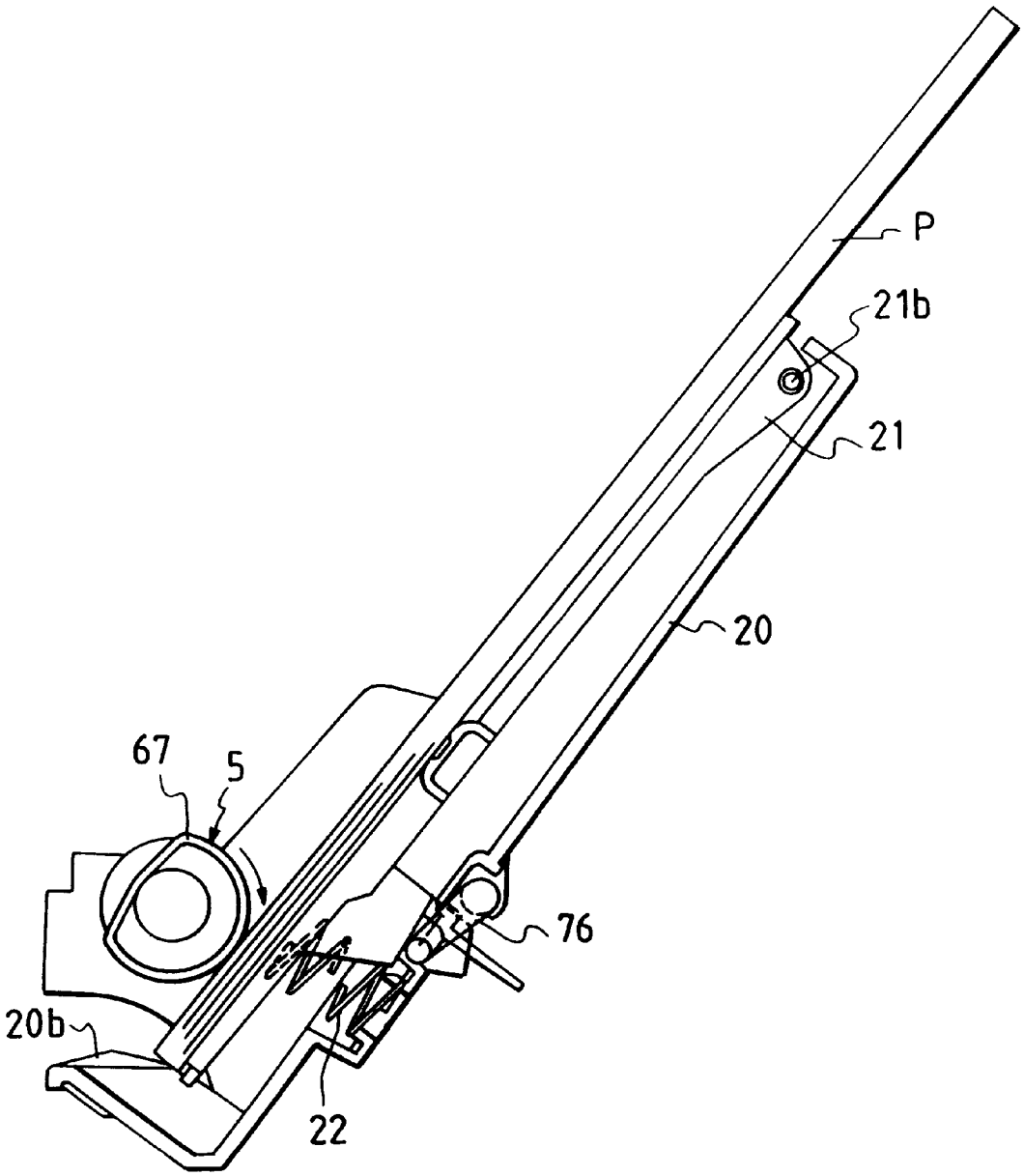

Next, main parts of the sheet feeding portion 11 will be described. Various parts of the sheet feeding portion 11 are attached to the base 20 to form a unit. As shown in FIG. 3, in the illustrated embodiment, the sheet feeding portion 11 serves to feed the sheet by utilizing one lateral edge of the sheet P as a reference, and a sheet standard (reference) surface is constituted by an inner wall of a right side plate of the base 20. As shown in FIG. 5A, the base 20 has a shape so that the pressure plate 21 can be retarded as shown in FIG. 5A. Further, the base is provided with recessed portions for positioning the pressure plate springs 22 at positions substantially opposed to roller portions 5*c* of the sheet feeding roller 5.

The pressure plate 21 is connected to the base 20 via pressure plate shafts 21*b* provided on both upper end portions of the pressure plate so that the pressure plate can be rotated around the pressure plate shafts 21*b*. As shown in FIG. 3, separation pads 73 made of material having relatively high frictional coefficient such as synthetic leather are adhered to the pressure plate 21 at positions opposed to the roller portions 5*c* of the sheet feeding roller 5, so that, when the number of the sheets on the pressure plate becomes few, double-feeding is prevented. Further, the movable side guide 19 slidable in a left-and-right direction is attached onto the pressure plate 21, so that, even when different size sheets P are used, one lateral edges of the sheets can be aligned by utilizing the sheet standard surface.

The sheet feeding roller 5 is rotatably supported by the base 20 at its both ends. The sheet feeding roller 5 is a integrally molded plastic part including a shaft portion 5*b* and the roller portions 5*c*, and the sheet feeding rubbers 67 for conveying the sheet P are provided on outer peripheral surfaces of the roller portions 5*c*. Each roller portion 5*c* has a D-cut (semicircular) shape. Further, sub-rollers 75 each having a radius smaller than a radius of the sheet feeding rubber 67 attached to the sheet feeding roller 5 by 0.5 mm to 3.0 mm are provided on both sides of the roller portion 5*c*, so that contamination of the image or positional deviation of the sheet feeding roller 5 is prevented by not contacting the sheet P with the roller rubbers 67 of the sheet feeding roller 5 other than the sheet feeding.

Further, in the illustrated embodiment, there are two roller portions 5*c* along the axial direction, which are spaced apart from the sheet standard surface by about 40 mm and about 170 mm, respectively. Accordingly, a recording sheet having A4 size is conveyed by the two roller portions 5*c*, and a post card is conveyed by only the single roller portion 5*c* near the sheet standard surface.

When the drive switching lever 66 of the cleaning portion 16 is shifted in the direction A in FIG. 1 by the carriage 50 to rotate the convey roller 36 normally, the switching output gear 83 is shifted to be engaged by the input gear 25, thereby transmitting the driving force to the sheet feeding portion 11 (refer to FIG. 2B). In this case, since the switching output gear 83 is rocked toward the direction engaging with the input gear 25 to engage by the latter, so long as these gears once meshed with each other, even when the carriage 50 is retarded to a direction opposite to the direction A, the engagement between the gears is maintained to continue the transmission of the driving force.

The input gear 25 transmits the driving force to a sheet feeding roller gear 28 coupled to the sheet feeding roller 5 through idler gears 26, 27. The sheet feeding roller 5 is rotated by the sheet feeding roller gear 28 to convey the sheet P.

Further, as shown in FIGS. 4A and 4B, the sheet feeding roller gear 28 transmits the driving force to the release cam 31 through a clutch gear 29 and an idler gear 30. In this case, the sheet feeding roller 5 and the release cam 31 are designed and arranged so that phases thereof are aligned with each other for each rotation. As a result, as shown in FIG. 4B, in the condition that the pressure plate 21 is released, as shown in FIG. 5A, the sheet feeding roller 5 is designed and arranged so that the semi-circular portions are opposed to the pressure plate 21.

The release cam 31 is so shaped that it releases the pressure plate 21 only between the angle of about 120 degrees of semi-circular portions of the sheet feeding roller 5 and that it contacts with the sheet P or the pressure plate 21 with an urging force of about 200 g to about 500 g when portion of the sheet feeding roller 5 other than the semi-circular portions is opposed to the pressure plate 21. Further, the release cam 31 releases the pressure plate 21 by depressing a depressed portion 21*c* of the pressure plate 21 protruded from a hole formed in the right side plate of the base 20 (refer to FIG. 4B).

In this case, the pressure plate cam 76 attached to the base 20 is depressed by a cam 21*d* near the depressed portion 21*c* of the pressure plate 21, with the result that the pressure plate cam 76 is rotated around a center 76*b*. And, a cam (not shown) outside of the left roller portion 5*c* is lowered by the pressure plate cam 76. As a result, even when the depressed portion 21*c* of the pressure plate 21 is depressed, the pressure plate 21 is not inclined with respect to the base 20, so that the pressure plate is released substantially horizontally.

The clutch gear 29 is provided at its interior with a clutch spring 77 (FIG. 3) so that the clutch spring 77 is tightened in a direction B in FIG. 4A, thereby preventing reverse rotation. Thus, when the switching from the sheet feeding portion 11 to the sheet convey portion is effected by the reverse rotation of the LF motor 47 or when the jammed sheet is removed or pulled by the operator, the sheet feeding roller 5 is not subjected to reverse rotation.

The separation claw 17 can be rotated around a center 17*b* and is biased by the claw spring 32 against the sheet P or the pressure plate 21 with an elastic force of about 20 g to about 100 g. The separation claw 17 serves to separate recording sheets P comprised of normal sheets and is positioned near the sheet standard surface as shown in FIGS. 4A and 4B to cover a corner of the sheet P in a triangular fashion. Since the sheets P are subjected to resistance from the triangular claw, the sheets can be separated one by one. Further, separation of thick sheets other than normal sheet is effected by abutting the sheets against a lower guide portion 20*b* (FIGS. 5A and 5B) of the base 20 (without engaging the separation claw 17 with the sheets) to utilize frictional resistance of the lower guide portion 20*b*, thereby separating the sheets one by one.

The releasing lever 33 and the releasing cam 35. (FIG. 4A) are provided in coaxial with the release cam 31 (FIG. 4B). The releasing lever 33 and the releasing cam 35 are not synchronous with the release cam 31 but are operated independently and aid to set the sheets P by the operator. The releasing lever 33 and the releasing cam 35 are interconnected through a gear.

The releasing lever 33 assumes (1) a feed position, (2) a thick sheet set position and (3) a normal sheet set position. An angle between these positions is selected to about 20 degrees to about 50 degrees. A ratio between the gears are set so that the releasing cam 35 is rotated by about 90 degrees in correspondence to three positions of the releasing lever 33.

(1) In the feed position, the releasing cam 35 does not act on the depressed portion 21*c* of the pressure plate 21 and a depressed portion 17*c* of the separation claw 17. This position is selected during normal sheet feeding.

(2) In the thick sheet set position, since the releasing cam 35 depresses only the depressed portion 21*c* of the pressure plate 21, the separation claw 17 is lowered to follow the pressure plate 21, with the result that the thick sheets can be set without engaging by the separation claw 17.

(3) In the normal sheet set position, since the releasing cam 35 depresses both the depressed portion 21*c* of the pressure plate 21 and the depressed portion 17*c* of the separation claw 17, the separation claw 17 is lifted with respect to the pressure plate 21, with the result that the normal sheets can be set with engaging by the separation claw 17.

Figure 6:
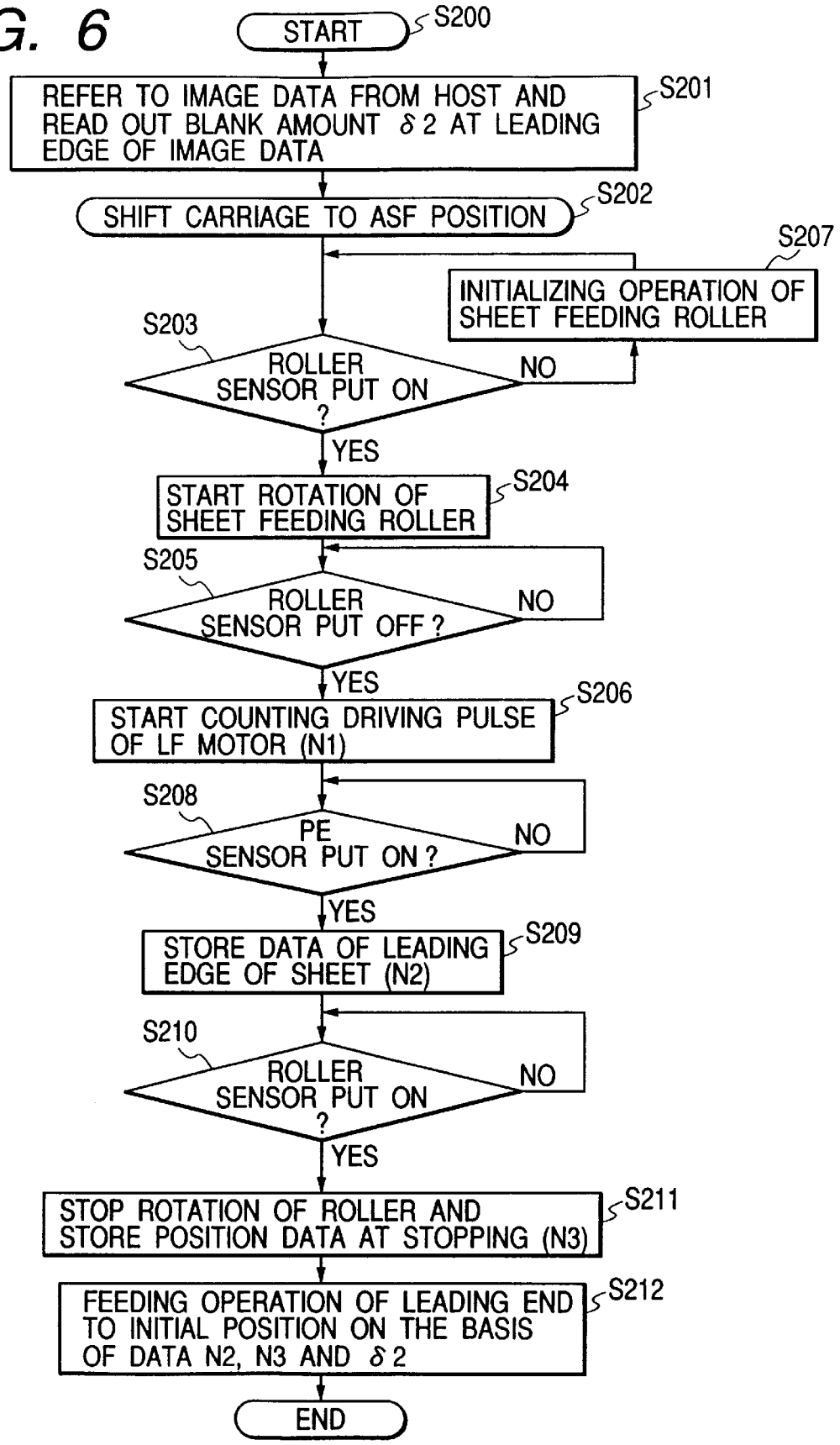
FIG. 6 is a flow chart showing control in a sheet feeding operation.

Incidentally, the above-mentioned group of gears (except for the sheet feeding roller shaft 79), separation claw 17, releasing lever 33 and releasing cam 35 are provided on shafts provided on the right side plate of the base 20 and are rotated around the shafts. Next, function and control of the sheet feeding portion 11 in the sheet feeding will be fully explained. FIG. 6 is a flow chart showing entire control. Although such control can be divided into control effected when the sheet feeding roller 5 is in the predetermined initial position and control effected if the sheet feeding roller is not in the predetermined initial position (trouble condition), in the illustrated embodiment, only the control effected when the sheet feeding roller 5 is in the predetermined initial position will be described.

In FIG. 6, in response to a sheet feeding start signal, first of all, in S200, while referring the image data from the host (for example, a computer to which the recording apparatus is connected), a blank amount at the leading edge of the image data is read out. In S202, the carriage 50 is shifted to shift the drive switching lever 66 so that the driving force of the convey roller 36 can be transmitted to the sheet feeding portion 11 (ASF position).

Then, in S203, the condition of the sheet feeding roller is judged (by the roller sensor). If the sheet feeding roller 5 is in the initial position, the program goes to S204; whereas, if the sheet feeding roller 5 is not in the initial position, initialization of the sheet feeding roller 5 is effected (S207). When the sheet feeding roller 5 is in the initial position, in S204, the sheet feeding roller 5 is rotated and, in S205, the edge of the sensor plate 69 (change from dark to bright of the sensor) is detected. In S206, by counting the number (N1) of drive pulses of the LF motor 47 after the detection, the angular position of the sheet feeding roller 5 can be controlled correctly, thereby effecting high accurate control.

When the sheet feeding roller 5 is rotated by about 60 degrees to bring cylindrical portions of the sheet feeding rubbers 67 to a position opposed to the sheet P, the release cam 31 rotated in synchronous with the sheet feeding roller 5 releases the pressure plate 21. As a result, since the sheet P is urged against the sheet feeding rubbers 67 by the biasing forces of the pressure plate springs 72, the conveying force for the sheet P is generated. After the pressure plate 21 is released, the carriage 50 can be retarded, so that the initializing operation (ink pre-discharge, wiping and the like) of the recording head 49 can freely be performed during the sheet feeding.

In S208, the leading edge of the sheet P being conveyed is detected by the PE sensor 42. If the PE sensor 42 is turned ON till the sheet feeding roller 5 is rotated by the predetermined amount, in S209, data (N2) of the position of the leading edge of the sheet is sought on the basis of the angular position of the sheet feeding roller 5 when the PE sensor 42 is turned ON and such data is stored. Then, in S210, by continuing the rotation of the sheet feeding roller 5 until the roller sensor is turned ON, the sheet P is conveyed ahead of the pair of rollers comprised of the convey roller 36 and the pinch roller 37. In S211, when the roller sensor is turned ON, the rotation of the convey roller 36 is stopped, and the position data (N3) thereof is stored.

In the feeding operation (heading) of the leading edge to the initial position for setting the leading edge blank (S212), the convey roller 36 is rotated reversely by the predetermined amount to disengage the switching output gear 83 from the input gear 25, thereby shifting the gear 83 up to the position shown in FIG. 2A. Thereafter, the convey roller 36 is rotated normally by the predetermined amount. When this feeding operation (heading) of the sheet is finished, the sheet feeding operation is completed.

Next, calculation of the normal and reverse rotation amounts of the convey roller in the feeding operation of the leading edge to the initial position for setting the leading edge blank will be explained with reference to FIGS. 7A to 7C and FIGS. 8A to 8C.

In FIGS. 7A to 7C and FIGS. 8A to 8C, "$\beta$" indicates a distance between the PE sensor 42 and the leading edge of the sheet when the sheet feeding roller 5 is stopped (completion of one rotation thereof), calculated on the basis of the data N2, N3; "$\gamma$" indicates a pre-set minimum reverse rotation amount required for switching the switching output gear 83 from the position shown in FIG. 2B to the position shown in FIG. 2A; "$\sigma$" indicates a pre-set normal rotation amount required for removing backlash; "$\delta$" indicates a blank amount at the leading edge of the sheet obtained by adding the blank $\delta 2$ for the image leading portion based upon the image data referred before initiation of the feeding operation (heading) to the pre-set blank $\delta 1$ between the leading edge of the sheet and the leading portion of the record permitting area ($\delta 1+\delta 2$); and "$\epsilon$" indicates a pre-set distance from the PE sensor 42 to the recording position (write starting position) of the recording head 49.

In the illustrated embodiment, after the sheet feeding roller 5 is rotated by one rotation, when the feeding operation of the leading edge of the sheet to the initial position is effected by the reverse and normal rotations of the convey roller 36, before the initiation of such feeding operation, by referring the blank at the leading edge of the image data, in accordance with the blank amount at the leading edge of the sheet obtained by adding the blank at the leading edge of the image data to the blank between the leading edge of the sheet and the leading portion of the record permitting area, and in accordance with the normal rotation amount of the sheet P until one rotation of the sheet feeding roller 5 is completed after the leading edge of the sheet was detected, the conveying amount of the sheet P achieved by the reverse and normal rotations of the convey roller 36 is controlled.

Figures 7A, 7B, 7C:
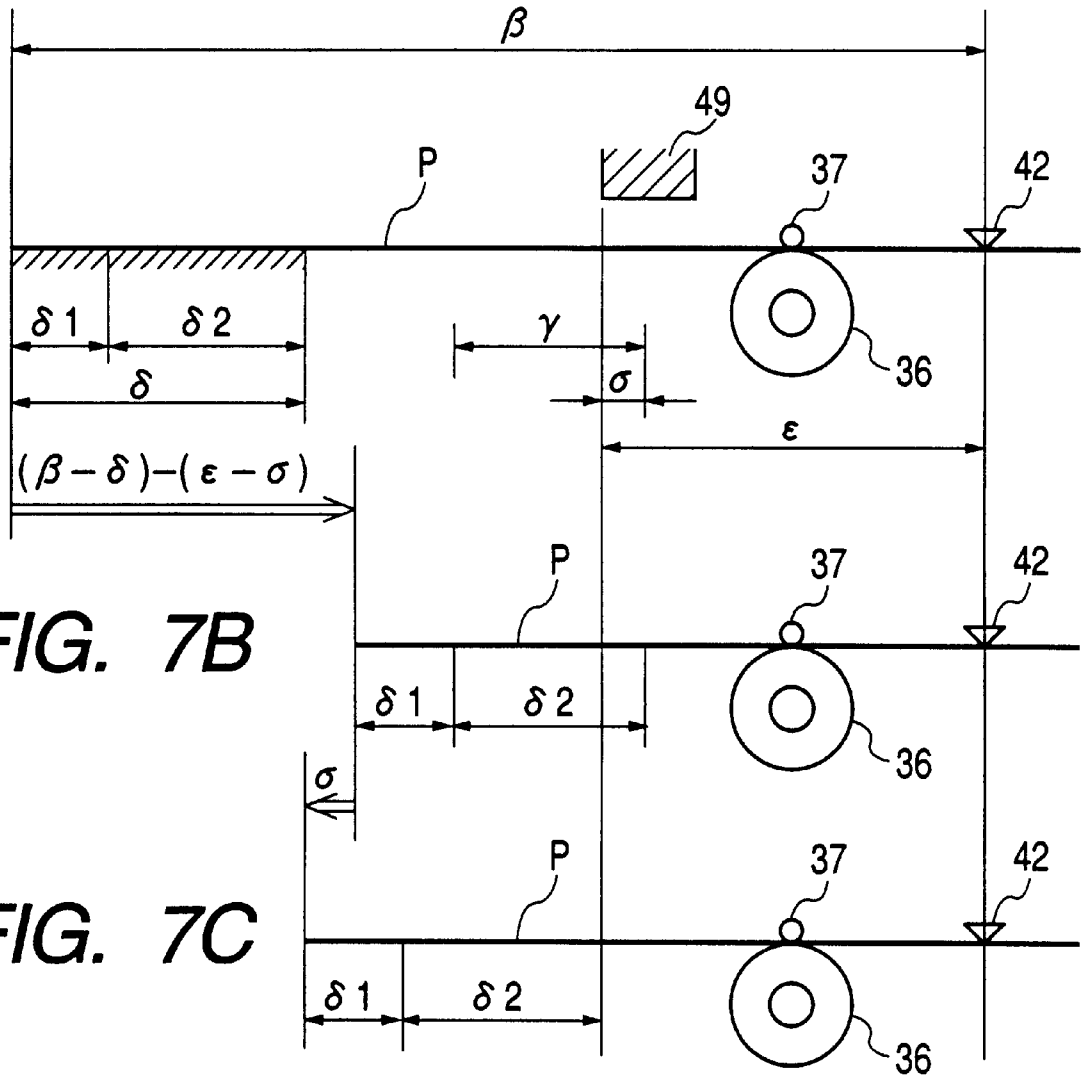
FIGS. 7A, 7B and 7C are explanatory views of a feeding operation of a leading edge to an initial position.

Concretely, as shown in FIG. 7A, after the sheet feeding roller 5 is rotated by one rotation, if the relationship between the distances is ($\epsilon-\sigma+\gamma<\beta-\delta$) (i.e., if the blank amount is small), as shown in FIG. 7B, the convey roller 36 is rotated reversely in a direction shown by the thick arrow to convey the sheet P in the reverse direction by a distance $\{(\beta-\delta)-(\epsilon-\sigma)\}$, so that the position of the switching output gear 83 is fixed by the drive switching lever 66. Thereafter, as shown in FIG. 7C, the convey roller 38 is rotated again normally in a direction shown by the thick arrow to convey the sheet P in the normal direction by the distance $\sigma$.

More specifically, for example, similar to the conventional case, when $\beta$=20 mm, $\epsilon$=8 mm, $\gamma$=5 mm, $\sigma$=1 mm, $\delta 1$=2 mm and $\delta 2$=4 mm, the shifting amount of the sheet required for the feeding operation of the leading edge to the initial position becomes $\{(\beta-\delta)-(\epsilon-\sigma)+\sigma\}$=8 mm, which is greatly reduced in comparison with 16 mm in the conventional case.

Figures 8A, 8B, 8C:
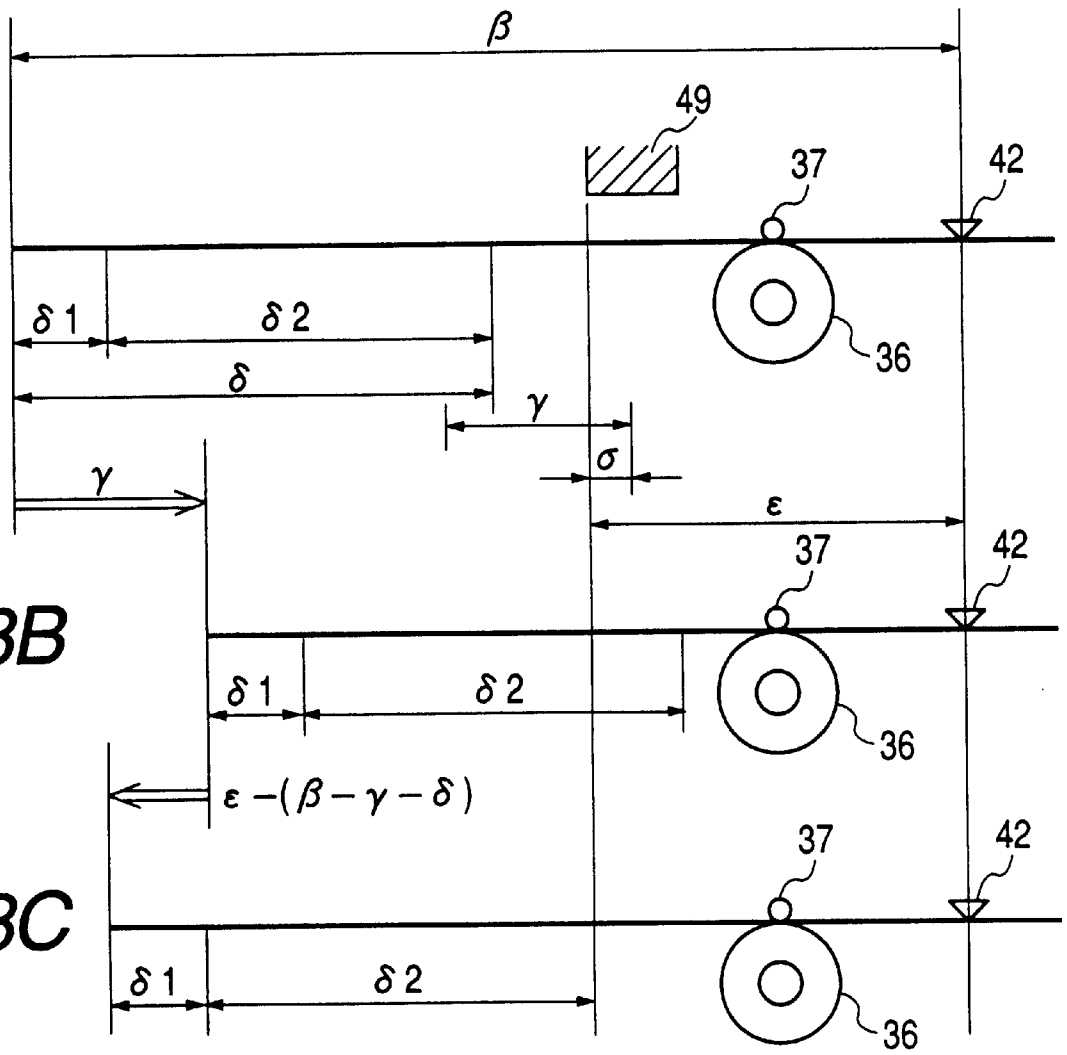
FIGS. 8A, 8B and 8C are explanatory views of a feeding operation of a leading edge to an initial position.
Figures 9A, 9B, 9C, 9D:
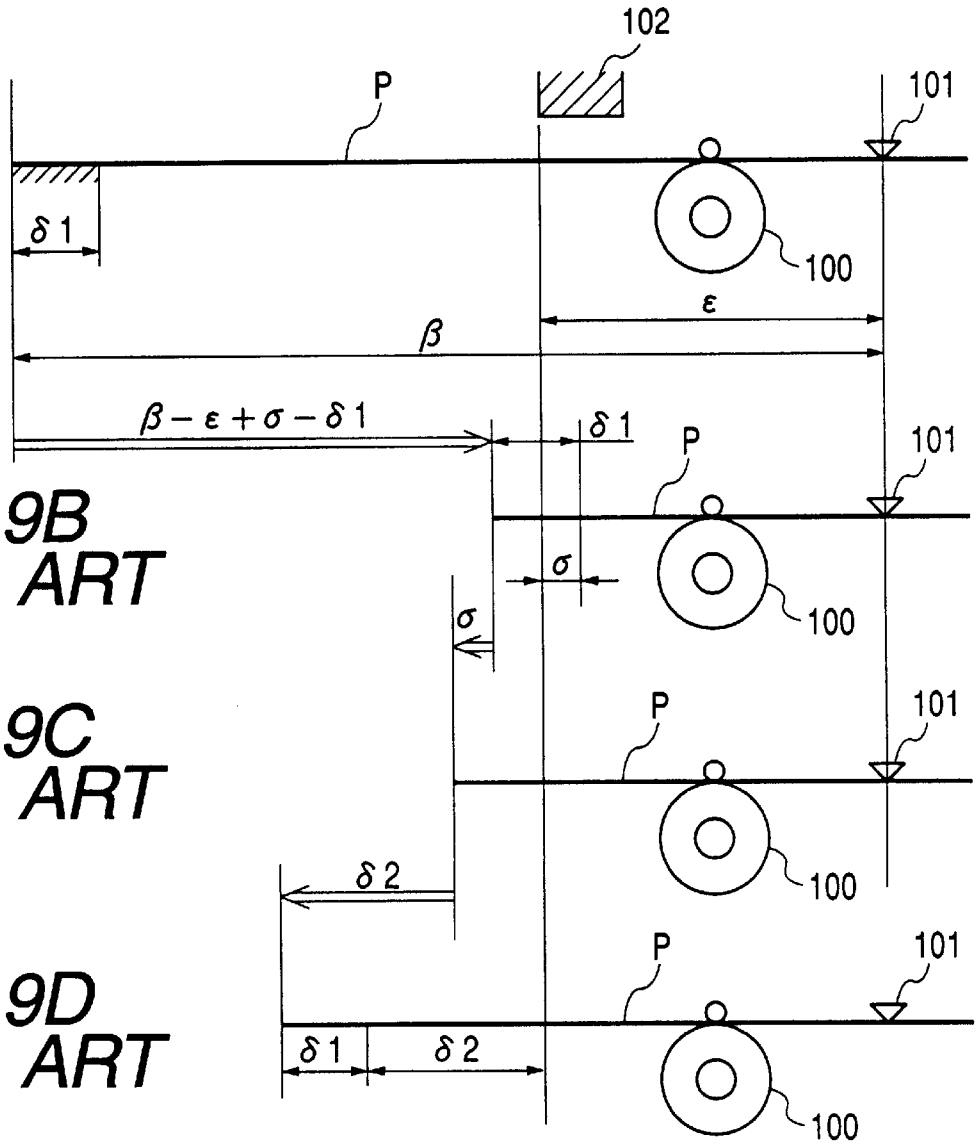
FIG. 9A PRIOR ART
FIG. 9B PRIOR ART
FIG. 9C PRIOR ART
FIG. 9D PRIOR ART
FIGS. 9A, 9B, 9C and 9D are views of for explaining a conventional technique.

On the other hand, as shown in FIG. 8A, after the sheet feeding roller 5 is rotated by one rotation, if the relationship between the distances is ($\epsilon-\sigma+\gamma>\beta-\delta$) (i.e., if the blank amount is great), as shown in FIG. 8B, the convey roller 36 is rotated reversely in a direction shown by the arrow to convey the sheet P in the reverse direction by the distance $\gamma$, so that the position of the switching output gear 83 is fixed by the drive switching lever 66. Thereafter, as shown in FIG. 8C, the convey roller 38 is rotated again normally in a direction shown by the arrow to convey the sheet P in the normal direction by a distance $\{\epsilon-(\beta-\gamma-\delta)\}$.

As is in the above case, for example, similar to the conventional case, when $\beta$=20 mm, $\epsilon$=8 mm, $\gamma$=5 mm, $\sigma$=1 mm and $\delta 1$=2 mm and further when $\delta 2$=8 mm (more disadvantageous in the conventional case), the shifting amount of the sheet required for the feeding operation of the leading edge to the initial position becomes $\{\gamma+\epsilon-(\beta-\gamma-\delta)\}$=6 mm, which is further greatly reduced in comparison with 16 mm in the conventional case.

When the feeding operation (heading) of the leading edge to the initial position to set the leading edge blank is completed in this way, the proper heading amount is set, and the recording can be started.

With the arrangement as mentioned above, according to the illustrated embodiment, the conveying amount regarding feeding operation of the leading edge of the sheet to the initial position can be minimized, thereby improving the processing speed of the apparatus.

Incidentally, if the record starting position of the recording head along the sheet conveying direction is varied with recording modes, the blank amount at the leading edge of the image data and the recording mode prior to the initiation of the feeding operation of the leading edge of the sheet to the initial position are referred to, and, on the basis of such information, a distance $\epsilon 2$ from the PE sensor 42 to a record starting position of the recording head (recording head element) corresponding to said recording mode is used, in place of the above-mentioned distance $\epsilon$. In this way, the conveying amount regarding feeding operation of the leading edge of the sheet to the initial position can be further reduced.

In the illustrated embodiment, while an example that the printer is used as the recording apparatus was explained, the present invention is not limited to such an example, but may be applied, for example, to other recording apparatuses such as a copying machine, a facsimile and the like, and, by applying the present invention to a sheet feeding apparatus used with such a recording apparatus, the same advantages can be achieved.

Further, in the illustrated embodiment, while an example that the sheet feeding apparatus is detachably attachable to the recording apparatus was explained, the present invention is not limited to such an example, but may be applied, for example, to a sheet feeding apparatus integrally incorporated into a recording apparatus, and, by applying the present invention to a sheet feeding apparatus, the same advantages can be achieved.

Finally, in the illustrated embodiment, while an example that the recording system is of an electrophotographic type was explained, the present invention is not limited to such an example, but may use, for example, other recording systems such as an ink jet recording system.

What is claim is:

1. A sheet feeding apparatus comprising:

sheet stacking means for supporting a sheet;

a sheet feeding rotary member for feeding out the sheet from said sheet stacking means by one rotation control;

conveying means for conveying the sheet fed out by said sheet feeding rotary member to recording means;

leading edge detecting means for detecting a leading edge of the sheet fed out by said sheet feeding rotary member;

driving means for rotating said conveying means in normal and reverse directions; and drive transmission means for transmitting a driving force from said driving means to said sheet feeding rotary member. wherein said drive transmission means comprises an output gear and an input gear, said output gear capable of shifting to an engage position where said output gear is engaged with said input gear in the normal rotation of said conveying means in order to transmit the driving force and shifting to a disengage position where said output gear is disengaged from said input gear in the reverse rotation of said conveying means in order to release of transmission of the driving force, and fixing means for fixing or releasing a position of said output gear; and control means for controlling said driving means so as to feed the leading edge of the sheet to the initial position by the normal and reverse rotations of said conveying means after the sheet is fed out by one rotation of said sheet feeding rotary member, in accordance with a sheet leading edge blank amount based on a blank amount at the leading edge of the image data referred prior to initiation of a feeding operation of the leading edge of the sheet to an initial position, and, in accordance with a normal rotation convey amount of the sheet from when the leading edge of the sheet is detected by said leading edge detecting means to when one rotation of said sheet feeding rotary member is completed.

2. A sheet feeding apparatus according to claim 1, wherein said sheet leading edge blank amount is obtained by adding a blank amount between the leading edge of the sheet and a leading portion of a record permitting area to a blank amount at a leading edge of image data.

3. A sheet feeding apparatus according to claim 2, wherein, when it is assumed that a normal rotation convey distance from when the leading end of the sheet is detected by said leading edge detecting means to when one rotation of said sheet feeding rotary member is completed is $\beta$, a reverse rotation convey amount required for shifting said switching output gear to the position where said switching output gear is disengaged from said input gear is $\gamma$, a normal rotation convey amount required for removing backlash in the normal rotation after the reverse rotation is $\sigma$, a blank amount at the leading edge of the sheet is $\delta$, and a normal rotation convey amount from said leading edge detecting means to a recording position is $\epsilon$, if a relationship between said distances is $(\epsilon-\sigma+\gamma<\beta-\delta)$ after said sheet feeding rotary member is rotated by one rotation, said conveying means is rotated reversely to convey the sheet in the reverse direction by a distance $\{(\beta-\delta)-(\epsilon-\sigma)\}$, so that the position of said switching output gear is fixed by said fixing means, and, thereafter, said conveying means is rotated normally to convey the sheet in the normal direction by said distance $\sigma$, and, if said relationship is $(\epsilon-\sigma+\gamma>\beta-\delta)$, said conveying means is rotated reversely to convey the sheet in the reverse direction by said distance $\delta$, so that the position of said switching output gear is fixed by said fixing means, and, thereafter, said conveying means is rotated normally to convey the sheet in the normal direction by a distance $\{\epsilon-(\beta-\gamma\delta)\}$.

4. A sheet feeding apparatus according to claim 2, wherein, if a record starting position of said recording means in a sheet conveying direction is varied with recording modes, the blank amount at the leading edge of the image data and the recording mode prior to the initiation of the feeding operation of the leading edge of the sheet to the initial position are referred to, and, when it is assumed that a normal rotation convey distance from when the leading end of the sheet is detected by said leading edge detecting means to when one rotation of said sheet feeding rotary member is completed is $\beta$, a reverse rotation convey amount required for shifting said switching output gear to the position where said switching output gear is disengaged from said input gear is $\gamma$, a normal rotation convey amount required for removing backlash in the normal rotation after the reverse rotation is $\sigma$, a blank amount at the leading edge of the sheet is $\delta$, and a normal rotation convey amount from said leading edge detecting means to a recording position of said recording means corresponding to said recording mode is $\epsilon 2$, if a relationship between said distances is $(\epsilon 2-\sigma+\gamma<\beta-\delta)$ after said sheet feeding rotary member is rotated by one rotation, said conveying means is rotated reversely to convey the sheet in the reverse direction by a distance $\{(\beta-\delta)-(\epsilon 2-\sigma)\}$, so that the position of said switching output gear is fixed by said fixing means, and, thereafter, said conveying means is rotated normally to convey the sheet in the normal direction by said distance $\sigma$, and, if said relationship is $(\epsilon 2-\sigma+\gamma>\beta-\delta)$, said conveying means is rotated reversely to convey the sheet in the reverse direction by said distance y, so that the position of said switching output gear is fixed by said fixing means, and, thereafter, said conveying means is rotated normally to convey the sheet in the normal direction by a distance $\{\epsilon 2-(\beta-\gamma-\delta)\}$.

5. A recording apparatus comprising:

sheet stacking means for supporting a sheet;

a sheet feeding rotary member for feeding out the sheet from said sheet stacking means by one rotation control;

conveying means for conveying the sheet fed out by said sheet feeding rotary member to recording means;

leading edge detecting means for detecting a leading edge of the sheet fed out by said sheet feeding rotary member;

driving means for rotating said conveying means in normal and reverse directions;

control means for controlling said driving means; and recording means for recording on the sheet conveyed by said conveying means; and wherein said control means controls a conveying amount of the sheet by the normal and reverse rotations of said conveying means, in accordance with a sheet leading edge blank amount obtained by adding a blank amount between the leading edge of the sheet and a leading portion of a record permitting area to a blank amount at a leading edge of image data, and, in accordance with a normal rotation convey amount of the sheet from when the leading edge of the sheet is detected by said leading edge detecting means to when one rotation of said sheet feeding rotation member is completed, to a blank amount at the leading edge of the image data prior to initiation of a feeding operation of the leading edge of the sheet to an initial position, when the sheet is conveyed to feed the leading edge of the sheet to the initial position by the normal and reverse rotation of said conveying means after the sheet is fed out by one rotation of said sheet feeding rotary member.

6. A recording apparatus according to claim 5, wherein said recording means is of an ink jet recording type in which ink is discharged onto the sheet to record.

* * * * *

UNITED STATES PATENT AND TRADEMARK OFFICE

CERTIFICATE OF CORRECTION

PATENT NO. : 6,183,151 B1
DATED : February 6, 2001
INVENTOR(S) : Takeshi Kono

It is certified that error appears in the above-identified patent and that said Letters Patent is hereby corrected as shown below:

Column 3,
Line 37, "of" should be deleted.

Column 10,
Line 60, "claim" should read -- claimed --.

Column 11,
Line 59, "δ" should read -- γ --.
Line 63, "{ε- (β-γδ) }." should read -- {ε- (β-γ-δ) }. --.

Column 12,
Line 55, "to" should read -- referring to --.

Signed and Sealed this

Eighth Day of January, 2002

*Attest:*

*Attesting Officer*

JAMES E. ROGAN
*Director of the United States Patent and Trademark Office*